US005353928A

United States Patent [19]

Schumacher

[11] Patent Number: 5,353,928

[45] Date of Patent: Oct. 11, 1994

[54] MULTICOMPONENT PACKAGE

[75] Inventor: Clemens Schumacher, Sundern, Fed. Rep. of Germany

[73] Assignee: Robert Finke GmbH & Co. KG, Finnentrop, Fed. Rep. of Germany

[21] Appl. No.: 834,337

[22] PCT Filed: May 21, 1991

[86] PCT No.: PCT/EP91/00943

§ 371 Date: Feb. 13, 1992

§ 102(e) Date: Feb. 13, 1992

[87] PCT Pub. No.: WO91/17930

PCT Pub. Date: Nov. 28, 1991

[30] Foreign Application Priority Data

May 21, 1990 [DE] Fed. Rep. of Germany ..... 4016282

[51] Int. Cl.[5] ..... B65D 25/08

[52] U.S. Cl. ..... 206/222; 206/219; 215/DIG. 8

[58] Field of Search ..... 206/219, 221; 215/DIG. 8

[56] References Cited

U.S. PATENT DOCUMENTS

| | | | |
|---|---|---|---|
| 2,288,895 | 7/1942 | Fink | 206/222 |
| 3,802,604 | 4/1974 | Morane et al. | 206/222 |
| 4,615,437 | 10/1986 | Finke et al. | 206/222 |
| 4,627,986 | 12/1986 | Bardsley et al. | 206/219 |
| 4,757,916 | 7/1988 | Goncalves | 206/222 |

FOREIGN PATENT DOCUMENTS

| | | |
|---|---|---|
| 0133293 | 2/1985 | European Pat. Off. . |
| 0237889 | 9/1987 | European Pat. Off. . |
| 1939086 | 2/1971 | Fed. Rep. of Germany . |
| 2211753 | 9/1972 | Fed. Rep. of Germany . |
| 8423325 | 8/1985 | Fed. Rep. of Germany . |
| 8900291 | 5/1990 | Fed. Rep. of Germany . |
| 2305364 | 10/1976 | France . |
| 2506726 | 12/1982 | France . |

*Primary Examiner*—David T. Fidei
*Attorney, Agent, or Firm*—Martin A. Farber

[57] ABSTRACT

The present invention relates to a multicomponent package having an outer container (1), a screw cap (4) screwed thereon, and an inserted cup (2, 3) the bottom (6, 7) of which has a predetermined breaking line (10, 11) which can be acted on by an impact edge (8', 9') which is aligned with the annular step (14, 15), and it proposes, in order to obtain a solution which is particularly favorable in use, that there be provided at least one additional inserted cup (3), which is centered in the first inserted cup (2), the cup wall (21) of which, continued in axial direction beyond the bottom of the cup, forms an impact collar (9) of its own.

25 Claims, 3 Drawing Sheets

MULTICOMPONENT PACKAGE

FIELD AND BACKGROUND OF THE INVENTION

The present invention relates to a multicomponent package.

Such a multicomponent package is known from EP 0 133 293. The two-component package proposed there provides for an inserted cup which can be inserted into the neck opening of an outer container so that two components of the outer container and the inserted cup can be stored separately. By screwing down the screw cap beyond the basic sales position the annular step of the bottom of the cup is struck by an impact edge so that the predetermined breaking line is broken and the inserted cup drops into the outside container so that the two components are brought together. Such a cup, however, needs improvement since it can receive only two components separately and furthermore, due to the complete breaking off of the bottom of the cup, said bottom may come into a blocking position in front of the discharge opening.

SUMMARY OF THE INVENTION

The object of the present invention therefore is to improve the possibilities of use of a multicomponent package of this type, which is of simple structural shape.

By virtue of the invention, a multicomponent package is obtained which has several inserted cups which can be placed one within the other. A first inserted cup is inserted firmly into the neck opening of the outer container. One or more second inserted cups are inserted into the first inserted cup. By further screwing down the screw cap beyond the basic sales position, a predetermined breaking line of each inserted cup is torn. For this purpose, the annular steps are acted on by the impact edge of an impact collar. The cup wall of a second insert cup is advantageously so continued in axial direction on its bottom side that it forms the impact collar for the tearing of the predetermined breaking line of the inserted cup which receives the second inserted cup.

If there is only one second inserted cup, the impact edge formed by the continuation of the wall of the cup strikes the annular step of the bottom of the first inserted cup. Several second inserted cups are also provided, each of which will form impact edges inserted in one another in order to tear open the bottom of the inserted cup which receives in each case the second inserted cup. The loosening of a bottom from the inserted cup is assured in a simple and reliable manner. Cup wall and cup bottom remain connected by a web of material, so that the bottom of the cup is suspended from the cup wall even when the predetermined breaking line has been torn open and does not drop into the outer container.

When the screw cap is screwed down on the outer container, the inserted cups are pushed together in telescopic manner, the annular steps of the cup bottoms being acted on in succession by the impact collars. The innermost second inserted cup is in this case advantageously acted on by an impact collar formed on the screw cap. The second inserted cups are so inserted one within the other that they are axially displaceable. A drive projection is preferably developed on the outer cup wall of the second inserted cup, said projection being arranged between a drive edge and a stop edge and being acted upon by them. If only one second inserted cup is provided then the stop edge is formed by a rim of the first inserted cup which surrounds the neck opening of the outer container. The drive edge is then formed by the end surface of a drive collar which is associated with the screw cap.

If several second inserted cups placed one within the other are provided in order to receive more than merely three components, then the drive projection of each second inserted cup strikes the stop edge formed by the upper edge of the inserted cup receiving it upon the further screwing on of the screw cap. If the last-mentioned inserted cup is also a second inserted cup, it is displaced axially by the striking on its upper edge. The drive projection is so arranged that after the tearing of the predetermined breaking line of the innermost second inserted cup the drive projection is acted upon by the drive edge of the screw cap upon further screwing on of the screw cap. After the tearing of the predetermined breaking line of the first inserted cup, its stop edge is acted on by the drive projection of the second inserted cup inserted in it upon the further screwing on of the screw cap. The drive projection is preferably developed in the manner that it annularly surrounds the second inserted cup.

In order to obtain optimal separation of the predetermined breaking line, the cross-sectional surfaces formed by the impact edge and the annular step extend perpendicular to the axis of rotation of the screw cap. Furthermore, a distance is provided between the impact edge and the annular step when the screw cap is not screwed on. In order to assure the dependable holding of the screw cap on the outer container when the screw cap is not screwed down, a circumferential detent edge is provided on the neck opening of the outer container, via which detent edge the screw cap is clipped on by means of an annular bead. By these and other rubbing surfaces of the screw cap with outer a container and inserted cups, greater force for the screwing down is required. A screwing down and the separation of the intended breaking lines connected therewith for the bringing together of the components is thus possible only by intentional turning of the screw cap. The closure cap advantageously has an opening which can be closed by a closure cap. In this way, the screw cap need not be removed in order to remove the component mixture, the discharge of the mixture being effected rather through all inserted cups through the opening of the screw cap.

In order to prevent the individual components mixing with each other before the tearing of the intended breaking lines, a sealing bead is arranged between the cup wall and the impact collar extending therein. This bead, which is formed on the cup wall, tightly surrounds the impact collar and is applied so closely that a radial application pressure prevails. For the dependable parallel guidance of the axially displaceable second inserted cups, two beads parallel to each other are provided. In this way, a double sealing can furthermore be effected. The bottom of the cup can be developed in pot shape. This permits simpler manufacture. In order to prevent a shearing off of the web upon the further screwing down of the protective cap and to assure an effective swinging off of the cup bottoms after the tearing of the intended breaking lines, the webs which connect the cup bottom with the cup wall form a run-on ramp for the impact edges of the impact collar when the predetermined breaking line is torn.

BRIEF DESCRIPTION OF THE DRAWINGS

The invention will be described in detail below with reference to an embodiment shown in the drawing in which.

DETAILED DESCRIPTION OF THE PREFERRED EMBODIMENTS

Figure 1:
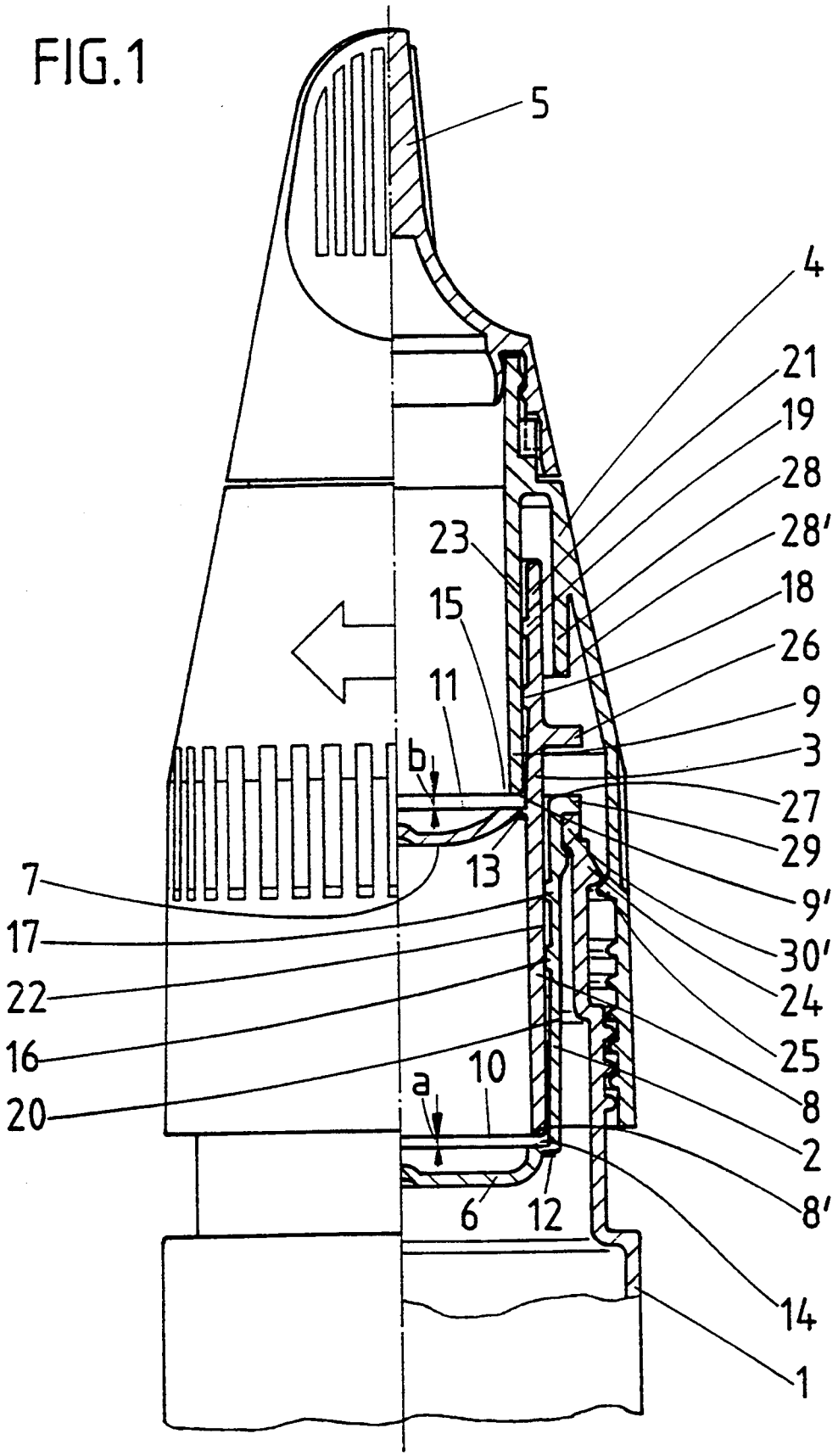
FIG. 1 shows a multicomponent package in a half section in the basic sales position.
Figure 2:
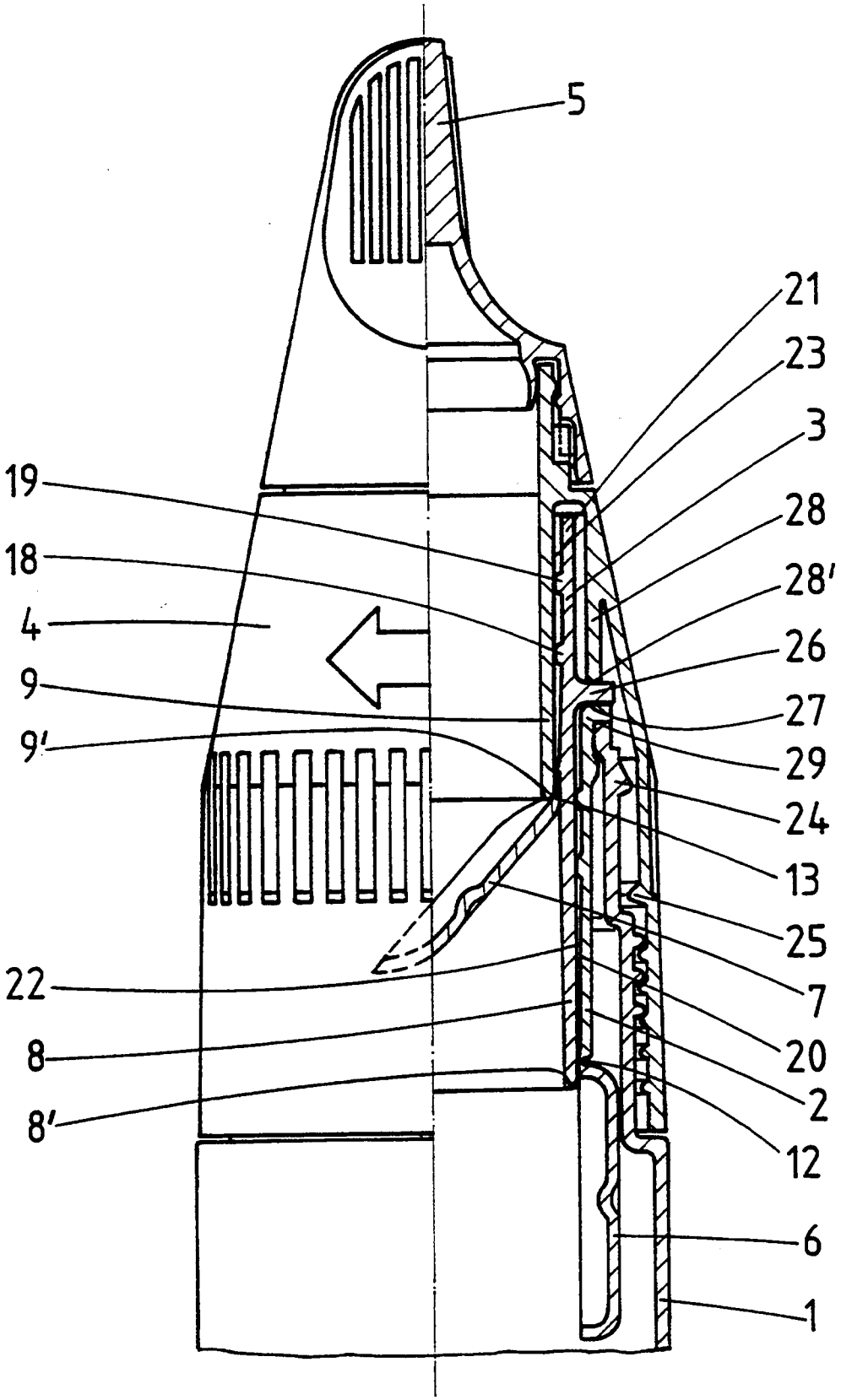
FIG. 2 is a view in accordance with FIG. 1 but with the screw cap screwed down completely.

The multicomponent package shown in FIGS. 1 and 2 consists of an outer container 1 into which a first inserted cup 2 is inserted. A second inserted cup 3 is received within the first inserted cup 2. A screw cap 4 is screwed onto the outer container 1, said cap having an opening which is closed by a closure cap 5.

The first inserted cup 2 is inserted in the outer container 1 in such a manner that its cup edge 29 extends over the neck opening of the outer container 1. The inserted cup 2 is clipped into the outer container 1 so that axial displacement of this first inserted cup 2 is not possible upon normal use of the multicomponent package. In particular, however, said clip engagement is intended to avoid the inserted cup 2 again jumping upward after the filling of the outer container 1 and the subsequent insertion of the inserted cup 2 as a result of the compression occurring thereby in the bottle. If this should happen, then, after the placing on of the remaining telescopic system, the inserted cup 2 would not have the correct sealed position with respect to the bottle, that is to say, the outer container 1, or it would force itself, due to the telescopic system, into the correct sealing position but then, later on, the intended breaking places mentioned below would be unfavorably prematurely stressed. It should not happen that the places of intended breakage take up assembly work.

The second inserted cup 3 has its impact collar 8 inserted into the first inserted cup 2. The impact collar 8 is extended beyond the cup bottom 7 by an axial extension of cup wall 21.

The impact collar 9, which is integral with the screw cap 4, extends into the second inserted cup 3.

Each cup wall 20, 21 has two annular beads 16, 17, 18, 19 which are annularly formed on the inner wall of the cup. The inside diameter of these beads 16, 17, 18, 19 is so dimensioned that they tightly surround the corresponding surrounding impact collars 8, 9 and act on them with a radial pressure so that a seal is formed.

First insert cup 2 and second insert cup 3 each have a pot-shaped bottom 6, 7 which is connected to the cup wall 20, 21 by a predetermined breaking line 10, 11. The cup bottoms 6, 7 furthermore have annular steps 14, 15 which form a plane perpendicular to the screwing axis of the screw cap. The impact edges 8', 9' of the impact collars 8, 9 extend parallel to the these annular steps 14, 15 at a distance away a, b. The distances a and b correspond approximately to the wall thickness of the container bottoms 6 and 7 respectively.

The second cup 3 is furthermore annularly surrounded by a drive projection 26. The drive projection 26 is arranged between the stop edge formed by the cup edge 29 of the first inserted cup 2 and the drive edge 28' formed by the end surface of a drive collar associated with the screw cap 4.

Cup bottoms 6, 7 and cup walls 20, 21 are in each case connected by a web 12, 13. This web material 12, 13, when the intended breaking line 10, 11 is broken, forms a firm physical connection in the form of a film hinge between the edge of the cup bottom 6, 7 and cup wall 20, 21.

In the basic sales position only a few threads of the screw cap 4 and the outer container 1 are engaged with each other. The screw cap 4 is secured against the unscrewing of the screw cap 4 from the outer container 1 by a detent bead 25 which grips over the detent edge 24 of the outer container 1.

If the screw cap 4 is now screwed down further, the impact edge 9 is shifted downward and its impact edge 9' strikes against the annular step 15 of the second inserted cup 3. Further screwing down then either first of all displaces the second inserted cup 3 downward by the displacement path a, so that the impact edge 8' of the impact collar 8 strikes against the annular step 14, or the annular step 15 is so acted on by the impact edge 9' that the intended breaking line 11 is torn open. After the tearing of the predetermined breaking line 11, the impact collar 9 is displaced further downward, it coming onto the run-on bevel formed by the web 13 and swinging the cup bottom 7 downward. This relative movement of impact collar 9 with respect to the second inserted cup 3 is continued until the drive projection 26 is acted on by the drive edge 28' of the drive collar 28.

Further downward screwing of the screw cap 4 now leads to the annular step 14 being acted on by the impact edge 8' of the impact collar 8 until the predetermined breaking line 10 of the first inserted cup has been torn. Further axial displacement of the second inserted cup 3 downward leads to the impact collar 8 running onto the run-on bevel formed by the web 12 together with the annular step 14 and to a following swinging of the cup bottom 6 towards the side.

The screwing down of the screw cap 4 can be continued until the drive projection 26 strikes against the stop edge 27. This is the position shown in FIG. 2.

In the embodiment shown in FIGS. 1 and 2 the closure cap 5 is a screwable reclosable cap. In the case of the screw cap 4 shown in FIG. 3, the closure cap 5 is formed on the screw cap and can be twisted off in order to open the screw-cap opening. Nevertheless, the closure cap 5, which in this case is developed in the form of a stopper, can be closed again in the manner that the upper section adjoining the corresponding place of intended breakage is pressed into the corresponding opening of the screw cap. Of course, other means can also be used here in order to obtain the possibility of reclosing, for instance in the form of a screw closure. In the version in accordance with FIGS. 1 and 2, the lifting off of the screw cap is still considered as a screwing technique insofar as a single-flank guide is present, formed by circumferential ramps, visible in FIG. 2, which cooperate with mating ramps of the closure cap 5 present there. The placing on can be effected there correspondingly rapidly since it is merely necessary to overcome an insertion detent which acts between the upper end of the impact collar 9 and the closure cap 5. As stated, a conventional version of screwing can also take the place of the ramp development.

Figure 3:
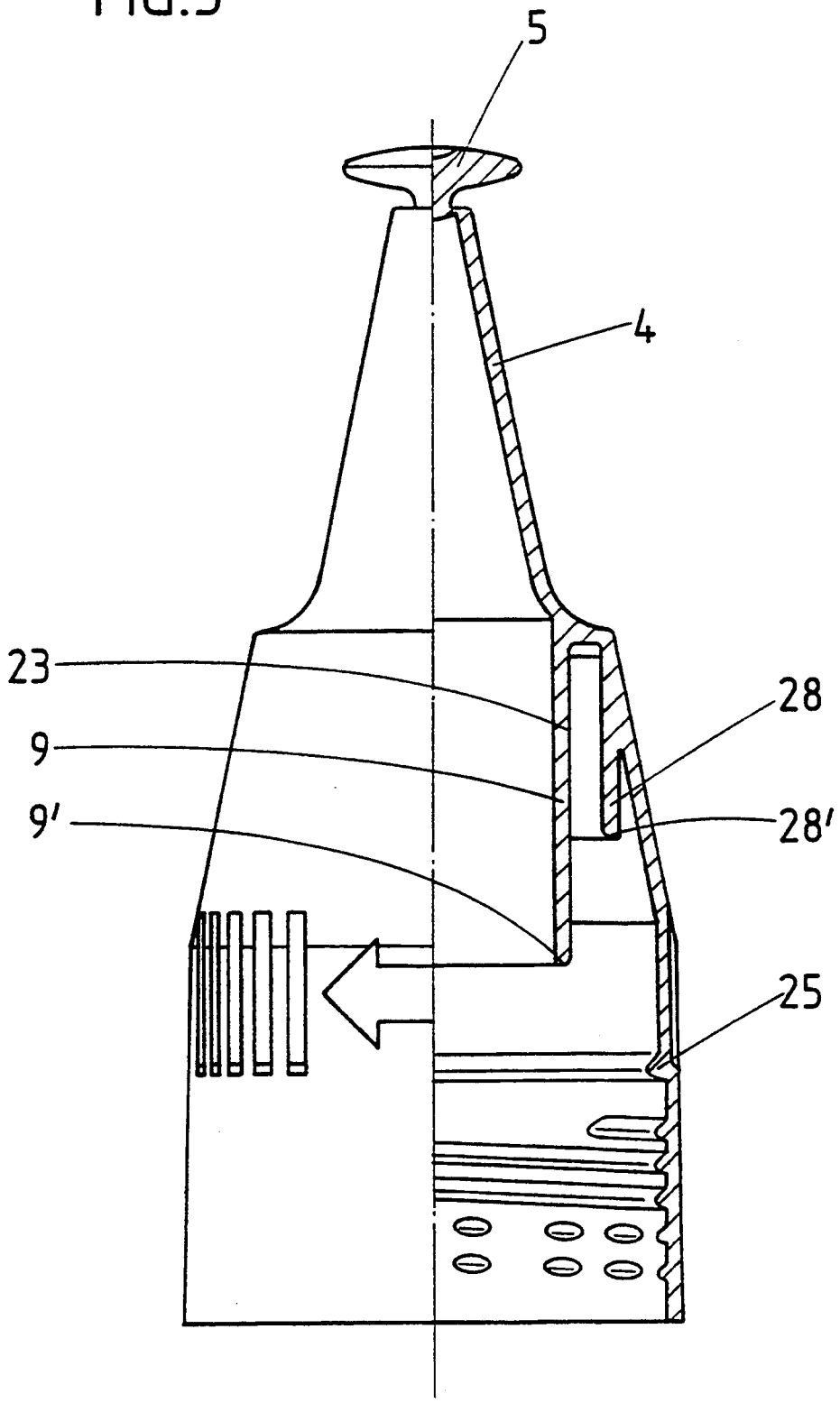
FIG. 3 shows a further development of a screw cap of a multicomponent package.

The nonintegral closure cap 5 consists of polyethylene (PE). It is softer than the screw cap 4, which is made of polypropylene (PP) which, as shown in FIG. 3, is developed directly on the closure cap 5. On the other hand, with respect to the second inserted cup 3 which assumes a ramp function, recourse is had to high density polyethylene (HDPE), which is harder than the material of which the first inserted cup 2 is made. The latter consists of low density polyethylene (LDPE). The screw cap 4 which serves as actuating handle is relatively harder than the two inserted cups 2, 3, the soft-tough material of which satisfies the functional demands of the film-hinge bridge material, particularly well.

I claim:

1. A multi-component package having an outer container with a neck opening in a top of the container, and a screw cap attachable to said container for covering said opening;

a first cup formed by a first bottom wall integrally connected to a first sidewall, there being an annular step between said first bottom wall and said first sidewall defining a line of weakness to enable separation of said first bottom wall from said first sidewall, said first cup being located within said container with a bottom of said first cup being adjacent to a bottom of a neck said container;

an impact collar having an annular sidewall with an open bottom edge coaxial to said container and to said first cup;

a second cup disposed in said container between said first cup and the top of said container, said second cup having a second bottom wall and a second sidewall connecting with the second bottom wall via a line of weakness, said second cup being connected to an inside surface of said annular sidewall of said impact collar, said impact collar extending from said first cup to encircle said second cup, and an outer surface of said annular sidewall of said impact collar being sealed to said first cup;

wherein rotation of said screw cap relative to said container causes separation of the connection between said second cup and said annular sidewall of said impact collar to force said second sidewall of said second cup towards said second bottom wall to separate said second bottom wall of said second cup from said second sidewall; and upon further movement of said impact collar away from the top of said container, said bottom edge of said impact collar engages with said annular step of said first cup to separate the first bottom wall of said first cup from said first sidewall.

2. A multi-component package having an outer container with a neck opening in a top of the container, and a screw cap attachable to said container for covering said opening;

a first cup formed by a first bottom wall integrally connected to a first sidewall, there being an annular step between said first bottom wall and said first sidewall defining a line of weakness to enable separation of said first bottom wall from said first sidewall, said first cup being located within said container with a bottom of said first cup being adjacent to the bottom of a neck said container;

a web which connects said first bottom wall of said first cup with said first sidewall;

a first impact collar having an annular sidewall with an open bottom edge coaxial to said container and to said first cup, an outer surface of said annular sidewall of said impact collar being sealed to said first cup;

a second cup disposed in said container between said first cup and the top of said container, said second cup having a second bottom wall and a second sidewall connecting with the second bottom wall, said second cup having an annular step in the region of a line of intended breakage;

a second impact collar which extends into said second cup, said second impact collar having an impact edge aligned with said annular step of said second cup for interaction with said step, there being a seal present between an outer surface of the second impact collar and the second sidewall of said second cup, said second impact collar extending from said screw cap, said second cup being displaceable along an axis of said container;

wherein rotation of said screw cap relative to said container causes movement of said first impact collar away from the top of said container, said bottom edge of said impact collar engaging with said annular step of said first cup to separate the first bottom wall of said first cup from said first sidewall, said web retaining a physical connection between said first bottom wall and said first sidewall.

3. A multicomponent package, according to claim 1, wherein said impact collar is formed on said screw cap.

4. A multicomponent package, according to claim 1, wherein said second cup is displaceable along an axis of said container.

5. A multicomponent package, according to claim 1, wherein said screw cap has a drive edge and said impact collar has a stop edge facing said drive edge; and a drive projection is developed on the second sidewall of said second cup and is arranged between said stop edge and said drive edge to be driven by said drive and said stop edges.

6. A multicomponent package, according to claim 5, wherein said stop edge grips over the neck opening of said container, said screw cap has drive collar extending along an exterior of said container, and said drive edge is formed by the end surface of said drive collar of said screw cap.

7. A multicomponent package, according to claim 5, wherein, upon a tearing of the weakness line said second cup, the drive projection is acted on by the drive edge upon a further screwing down of said screw cap.

8. A multicomponent package, according to claim 5, wherein, upon a tearing of the weakness line of said first cup, the stop edge is acted on by the drive projection upon a further screwing down of said cap.

9. A multicomponent package, according to claim 5, further comprising a plurality of interested cups including said first and said second cups, there being a projection for each cup in addition to said first cup, there being a stop edge for each cup in addition to said first cup, the drive projection of each additional cup acting on the stop edge formed by the upper edge of the cup receiving the projection upon a further screwing down of said screw cap.

10. A multicomponent package, according to claim 5, wherein said drive projection is developed annularly surrounding said second cup.

11. A multicomponent package, according to claim 1, wherein cross-sectional surfaces formed by the impact edge and the annular step extend perpendicular to an axis of rotation of said screw cap.

12. A multicomponent package, according to claim 1, further comprising a space between the impact edge and the annular step.

13. A multicomponent package, according to claim 1, further comprising a detent bead extending circumferentially from said screw cup, and a detent edge which is formed on the container and surrounds the neck opening, wherein said screw cap is secured by the detent bead to the detent edge.

14. A multicomponent package, according to claim 1, further comprising a closure cap, and wherein said screw cap has an opening which can be closed by the closure cap.

15. A multicomponent package, according to claim 1, further comprising two parallel beads extending from the first sidewall of said first cup toward said impact collar, and two parallel beads extending from said impact collar to the second sidewall of said second cup.

16. A multicomponent package, according to claim 1, wherein the cup bottom of each cup is concave.

17. A multicomponent package, according to claim 2, wherein, upon a tearing of a weakness line during movement of an impact edge of said first impact collar, said web guides the impact edge of said first impact collar.

18. A multicomponent package, according to claim 14, wherein said closure cap is fabricated of polyethylene (PE) and said screw cap is fabricated of polypropylene (PP), each cup is fabricated of high density polyethylene (HDPE) except for the first of said cups which is fabricated of a low density polyethylene (LDPE), and the closure cap of polyethylene (PE) is softer than the polypropylene (PP) of the screw cap, which in its turn is softer than the high density polyethylene (HDPE) of the inserted cup, which in its turn is harder than the low-density polyethylene (LDPE) of the first inserted cup.

19. A multicomponent package, according to claim 2, wherein said impact collar is formed on said screw cap.

20. A multicomponent package, according to claim 2, wherein the cross-sectional surfaces formed by the impact edge and the annular step extend perpendicular to an axis of rotation of said screw cap.

21. A multicomponent package, according to claim 2, further comprising a space between the impact edge and the annular step.

22. A multicomponent package, according to claim 2, further comprising a detent bead extending circumferentially from said screw cap, and a detent edge which is formed on the container and surrounds the neck opening, wherein said screw cap is secured by the detent bead to the detent edge.

23. A multicomponent package, according to claim 2, further comprising a closure cap, and wherein said screw cap has an opening which can be closed by the closure cap.

24. A multicomponent package, according to claim 2, further comprising two parallel beads extending from the first sidewall of said first cup toward said impact collar, and two parallel beads extending from said impact collar to the second sidewall of said second cup.

25. A multicomponent package, according to claim 2, wherein the cup bottom of a cup is concave.

* * * * *